United States Patent [19]

Schmidt

[11] 4,408,546

[45] Oct. 11, 1983

[54] HINGELESS SAFE DOOR ASSEMBLY

[76] Inventor: Jacob D. Schmidt, Box 68-204 Railroad Ave., Wagon Mound, N. Mex. 87752

[21] Appl. No.: 224,488

[22] Filed: Jan. 12, 1981

[51] Int. Cl.[3] ..... E06B 7/16; E05G 1/04; B65D 55/14; E05C 5/04

[52] U.S. Cl. ..... 109/75; 109/68; 292/251; 292/40; 70/163

[58] Field of Search ..... 109/64, 67, 68, 58.5, 109/60, 61; 70/161-167; 292/251, 52, 40, 29, 34, 26, 36, 143, 35, 173, 46, 139, 48, 158, 161, 165-167

[56] References Cited

U.S. PATENT DOCUMENTS

| | | | |
|---|---|---|---|
| 183,861 | 10/1876 | Mertens | 292/251 |
| 246,748 | 9/1881 | Gerard | 109/62 |
| 443,804 | 12/1890 | Stamm | 292/34 |
| 512,022 | 1/1894 | Power | 292/34 |
| 3,063,282 | 11/1962 | Aytes | 70/163 |
| 3,945,329 | 3/1976 | Bywater | 109/68 |
| 4,023,840 | 4/1977 | Souza et al. | 292/113 |

*Primary Examiner*—Gene Mancene
*Assistant Examiner*—John Weiss
*Attorney, Agent, or Firm*—Laurence R. Brown

[57] ABSTRACT

This invention provides a hingeless safe door assembly that can be flush mounted in a recessed safe compartment built into a wall or floor. Thus, a frame and flush cover plate holds the door assembly recessed away from the wall or floor for access to locking and latching mechanisms integral in the removable door.

A latch bolt operating mechanism axially moves a master bolt, and other slave bolts are similarly axially moved by a pivoted lever that engages both the master and slave bolt for concurrent axial movement between latched and unlatched positions.

1 Claim, 2 Drawing Figures

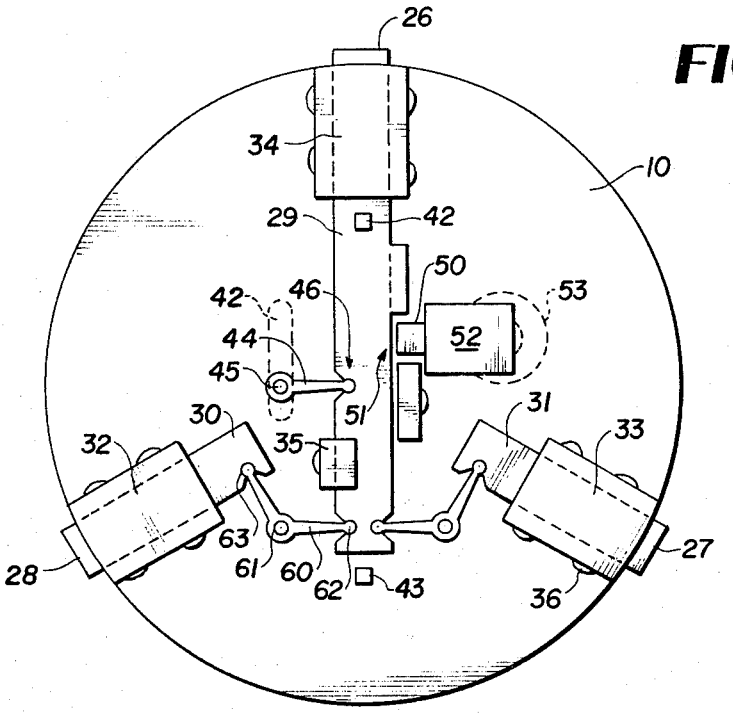
FIG.1
FIG.2
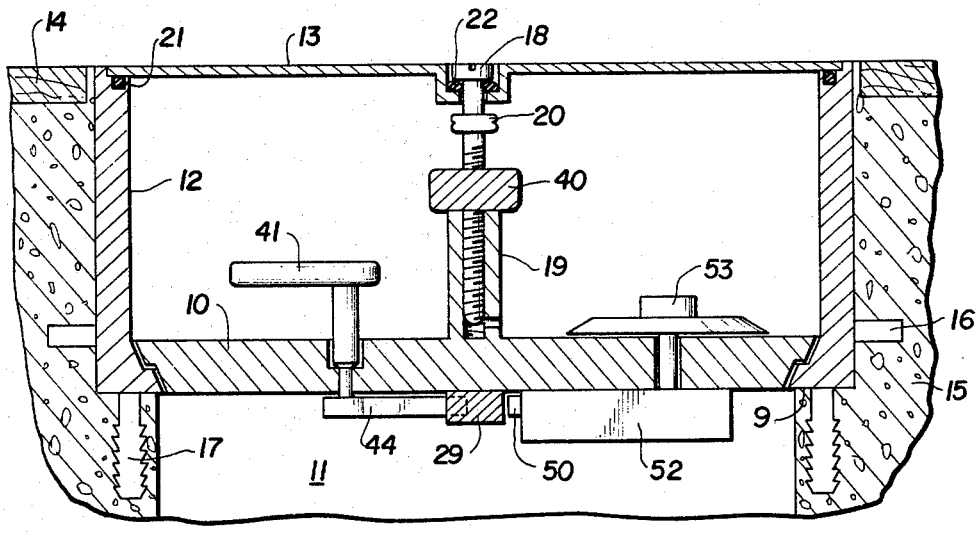

HINGELESS SAFE DOOR ASSEMBLY

FIELD OF THE INVENTION

This invention relates to safes and more particularly it relates to safe doors in walls or floors that provide access to a recessed safe compartment.

BACKGROUND ART

There has not been a satisfactory simple but strong and secure wall or floor type safe provided by the prior art. These safes are installed in a wall or a floor or protect a recessed compartment which may be reinforced cement poured in a foundation or floor when the house or building is constructed.

Many safes are provided with complete compartments, which may be lifted out or removed with the contents. That, of course, is undesirable.

Others provide hinged doors, which require expensive hardware, since hardened and break-proof components need be used. Any hardware such as hinges accessible from outside the safe compartment provides a way for unauthorized break-in.

The mechanical systems of most secure safes are extremely complex and thus are expensive and difficult to service and maintain. The complexity does not necessarily contribute to safety.

Accordingly, there is need to provide improved and secure safes that are not expensive or complex.

Other features, advantages and objectives of the invention will be found throughout the following description, drawings and claims.

DISCLOSURE OF THE INVENTION

This invention provides for a wall or floor safe a removable hingeless door assembly with integral latching mechanism, latching bolts and combination lock that can be installed in the opening of a recessed safe compartment built into the wall or floor.

A frame surrounds the door assembly and holds it in a recessed position where the latch mechanism and dial are available inside the recess. A cover plate mounts flush with the wall or floor.

A latching mechanism axially moves a first master bolt of a plurality of bolts, preferably three, if not impeded by the combination lock, and the remaining bolts are coupled as slave units to axially move along with the first bolt by means of a pivoted lever engaging both the master and slave bolts.

BRIEF DESCRIPTION OF THE DRAWINGS

In the drawings:

FIG. 1 is an inner elevation sketch of a hingeless removable door provided by the invention; and FIG. 2 is a section view of the door mounted in a frame-cover assembly flush mounted in a wall or floor to close a built-in safe compartment.

DESCRIPTION OF A PREFERRED EMBODIMENT

As may be seen from the drawings, the hingeless removable safe door 10 provided by this invention closes a built-in recessed safe compartment 11 and is mounted with framework assembly 12 and associated cover plate 13 for flush mounted installation in the wall or floor 14.

Typically a reinforced concrete wall 15 defines the receptacle compartment. However, the door assembly

10 also can be used with a conventional movable strengthened steel safe, as well, if desired, or the receptacle area may have alternative structural configuration. Tabs 16 and anchor rods 17 may be used if desired to anchor the frame 12 into a built-in concrete safe body. However, other means of securing the frame to the safe or building structure may be employed.

The cover plate 13 may be held in place by a single screw 18 mated with boss 19 on the door 10. Retainer 20 keeps the screw 18 in place when the cover is removed. Also the O rings 21, 22 may be provided, particularly in floor mounts to waterproof the sunken safe door and compartment.

The door 10 is hingeless and mates into receptacle shoulder 25 on frame 12 to be latched in place by mating of the extended latches 26, 27, 28 of latch bolts 29, 30, 31 on the lower edge 9 of the frame 12.

The bolts 29, 30, 31 slide axially in guides 32, 33, 34, 35, etc., which may be affixed to the inner side of door 10 by welding, etc. as indicated by tabs 36.

When unlatched the door 10 may be pulled out of registration by means of a handle structure 40, which can be used if desired in conjunction with the latch operating handle 41, which serves when rotated to slide master bolt 29 back and forth between limits set by stops 42, 43. Thus, the lever arm 44 swings about pivot axis 45, and by means of a suitable coupling to the master bolt 29 such as socket structure 46 permits the necessary latching movement. Movement is prevented out of latching position shown, when the reciprocatable lock member 50 is mated into groove 51 indented into the master bolt 29 structure. This lock member is conventionally operated by a combination lock mechanism 52 manipulated by dial 53.

Auxiliary slave latch bolts 30, 31 are simultaneously actuated by master latch bolt 29 through the medium of pivoted levers 60, which pivot around an axis 51 and are connected such as by socket structure 62, 63 respectively to the master and slave bolts to instigate sympathetic axial movement into and out of latching position.

It is therefore clear that this invention provides an improved unhinged safe door apparatus which is simple, inexpensive and yet strong and secure. The novel safe door structure is versatile and readily used in either conventional portable safes or in wall or floor mounted built-in receptacles, and permits inconspicuous mounting flush with wall or floor.

Having therefore set forth the improvements afforded by this invention and its mode of operation, those features of novelty believed characteristic of the spirit and nature of the invention are set forth with particularity in the following claims.

INDUSTRIAL APPLICATION

A safe can be made from a built-in recessed compartment in a wall or floor by mounting thereinto as the door a hingeless door assembly afforded by this invention containing the latching and combination lock mechanisms.

I claim:

1. A removable hingeless safe door for a safe compartment, comprising in combination, a lock assembly, a latch assembly with a plurality of interconnected latch bolts movable together in response to non-locked and locked positions of said lock assembly, said lock assembly and latch bolts being mounted on a circular plate having integrally secured thereto guide channels for movement of the latch bolts, said latch bolts being interconnected for movement together by means of pivotable levers connected to the bolts solely by socket joint structure, said door including a frame member for retaining the door in a recessed position in a wall or floor permitting access to the lock and latch assemblies, a cover plate fitting in the frame member to cover the door and provide a flush mounting member with a wall or floor in which the safe compartment resides, a watertight seal member between the cover plate and the frame member to keep the lock and latch assemblies free of water and a centrally mounted bolt flush with said cover plate extending into a mating receptacle on the circular plate to secure the cover against dislodging and to press against said seal, wherein the mating receptacle comprises handle structure for removing the circular plate.

* * * * *